United States Patent [19]

Palm

[11] Patent Number: 4,524,565

[45] Date of Patent: Jun. 25, 1985

[54] PACKING CONTAINER FOR PRESSURIZED CONTENTS AND A METHOD FOR MANUFACTURING THE SAME

[75] Inventor: Lars-Erik Palm, Staffanstorp, Sweden

[73] Assignee: Tetra Pak International AB, Lund, Sweden

[21] Appl. No.: 501,914

[22] Filed: Jun. 7, 1983

[30] Foreign Application Priority Data

Jun. 17, 1982 [SE] Sweden ..... 8203763

[51] Int. Cl.[3] ..... B65B 31/02

[52] U.S. Cl. ..... 53/449; 53/432; 426/411

[58] Field of Search ..... 53/432, 449; 428/35; 426/410, 411

[56] References Cited

U.S. PATENT DOCUMENTS

| | | | |
|---|---|---|---|
| 4,090,343 | 5/1978 | Rausing | 53/449 |
| 4,205,750 | 6/1980 | Dews | 53/449 |
| 4,342,183 | 8/1982 | Gordon et al. | 53/449 |
| 4,459,793 | 7/1984 | Zenger | 426/411 |

*Primary Examiner*—John E. Kittle
*Assistant Examiner*—James J. Seidleck
*Attorney, Agent, or Firm*—Burns, Doane, Swecker & Mathis

[57] ABSTRACT

A packing container for pressurized contents, e.g. beer or carbonated refreshing beverages, can be manufactured from different material combinations which together provide the packing container with the necessary strength as well as the required tightness for gas as well as liquid.

In accordance with the invention a packing container is formed having an outer casing which has several material layers and which provides the packing container with its strength and gas-tightness, and a liquid-tight inner container of flexible plastic material. In the manufacture and filling of the packing container, the capacity of the contents is used to give off gas so as to expand the inner container until it lies closely against the outer shell and at the same time force the air out of the casing so that the packing container is rendered completely free of air.

8 Claims, 5 Drawing Figures

PACKING CONTAINER FOR PRESSURIZED CONTENTS AND A METHOD FOR MANUFACTURING THE SAME

BACKGROUND OF THE INVENTION

The present invention relates to a packing container for pressurized contents, having an outer casing and a liquid-tight inner container. The invention also relates to a method for manufacturing a packaging container for pressurized contents, comprising an outer casing and a liquid-tight inner container.

Packing containers for pressurized contents, such as beer and carbonated refreshing beverages, exist in a great number of forms. One of the more common types is a 45 cl can which is manufactured from aluminium or a combination of sheet metal and aluminium. In the manufacture of such a container a shell wall formed by deep-drawing or by some other method is provided with one or more end walls which are joined to the shell wall by seaming. One end wall has a pre-manufactured opening arrangement.

Known types of cans are relatively expensive to manufacture and it is therefore a general objective to produce a packing container which, functions in a satisfactory manner and can be manufactured at a lower cost.

One suggestion in this respect is to make the packing container of different and cheaper material. However, up to now no packing container has been proposed which was of a cheaper design and at the same time had the strength and tightness of the conventional can. This is due to the fact that the cheaper materials which are available have different, and very frequently inferior, characteristics when it comes to withstanding the internal pressure in the packing container caused by its contents and to preventing gas exchange between the packing container and the surroundings.

These disadvantages can be avoided in the manufacture of packing containers by the combination of different types of material, so that the properties of each type of material are utilized and they are made to co-operate in the best possible manner. In a known type of a package an inner plastic container is thus provided which is surrounded by an outer, relatively thick paper casing which absorbs the pressure originating from the contents. The ends of the container, however, are not covered by the casing and have to be made, therefore, of considerably thicker material. The ends are given a shape which is appropriate in respect of the pressure loading but which is impractical from a user's point of view. This container also lacks a satisfactory gastight layer which has a negative effect on the keeping quality of the packed contents.

It is an object of the present invention to produce a packing container of the type mentioned in which different material layers are utilized in an optimum manner in respect of each of the different functions: strength, liquid-tightness and gas-tightness.

It is a further object of the present invention to produce a packing container wherein the consumption of material is minimized and is adapted so that the packing container obtains maximum strength and stability at the lower possible expense.

It is also an object of the present invention to produce a packing container wherein gas exchange between the inside and outside of the packing container is prevented at the same time as the presence of air is avoided in the packing container which may be harmful to the contents.

These and other objects have been achieved in accordance with the invention in a packing container for pressurized contents having an outer casing and a liquid-tight inner container. The outer casing includes a layer of gastight material which completely encloses the inner container and the inner container is manufactured from a flexible material which through the pressure originating from the contents is pressed against the outer casing.

By placing the gastight layer into the outer casing which has a stable shape and is almost unaffected by the internal pressure of the packing container, the tensile stresses in the gastight layer are avoided. This eliminates the problem of cracking, normally encountered in the earlier types of packages, which precluded the use of certain types of gastight layer, e.g. aluminium foil. Such the liquid-tight layer is manufactured from thin, flexible material which through the pressure of the contents is flattened against the inside of the outer casing and subsequently is not subjected to any further loads, no appreciable demands with regard to strength are made on it, so that the gastight as well as the liquid-tight layer may be made very thin.

As the liquid-tight layer is not gastight, it means that not only the space present inside the inner container which is not filled with contents, but also any space between the container and the casing, can be filled with gas originating from the contents which in contrast to the oxygen in the air is not harmful to the filled product.

It is a further object of the present invention to provide a method of manufacture of a packing container for pressurized contents, this method being adapted so that it can be carried out by means of automatic manufacturing and filling machines.

It is a further object of the present invention to provide a method of manufacture which makes possible the consecutive manufacture and filling of a packing container without any surrounding air being packed together with the contents or making contact with them in some other manner.

These and other objects have been achieved in accordance with the invention in a method for the manufacturing of a packing container for pressurized contents having an outer casing and a liquid-tight inner container. The inner container and its contents are introduced into the outer casing, the outer casing being made to enclose the inner container in a non-gastight manner and the contents are made to give off gas so that any air remaining in the outer casing is forced out whereupon the outer casing is sealed in a gastight manner.

The method in accordance with the invention makes use of the gas developed by the contents so as to induce the inner container to lie closely against the outer casing and to force out the air from the outer casing prior to being sealed in an airtight manner. The inventive method results in the inner casing which can be made of a very flexible and expandable plastic material being brought to lie particularly closely against the outer casing so that the air space is eliminated and the container obtains the required mechanical support from the outer casing.

BRIEF DESCRIPTION OF THE DRAWINGS

A preferred embodiment of the packing container as well as of the method in accordance with the invention will now be described in detail with special reference to the enclosed schematic drawings, wherein like elements bear like reference numerals, and wherein.

DETAILED DESCRIPTION OF THE PREFERRED EMBODIMENT

The packing container in accordance with the invention is intended for the packaging of pressurized contents, in particular beer, carbonated refreshing beverages etc. The design of the packing container is such that its various parts can be made of different materials, each of which has the particular properties required for the different parts. In this manner the special properties of each material can be made use of in an optimum manner so that the comsumption of material and consequently the costs of the finished packing container are kept to a minimum. The demand made first and foremost on a packing container of this type is that above all it should be capable of withstanding the relatively high internal pressure which can arise in the filled container, especially if the same is kept for a prolonged period in a warm place. Secondly the packing container must be completely liquid-tight, so that no leakage can occur under any conditions whatever. Finally the packing container must also have maximum gas-tightness in order to ensure long keeping quality of the packed product, which is particularly important in the packaging of beer.

In order to fulfill in the best possible manner the three requirements and also to be well adapted to modern handling and consumption, the packing container in accordance with the invention comprises different material layers each of which possesses the optimum prerequisites for meeting the abovementioned demands. More particularly, the packing container includes an outer casing and a liquid-tight inner container. The outer casing gives the packing container the necessary strength and stability and the inner casing makes the packing container liquid-tight. The third, gas-tightening function is provided by a gastight layer which is preferably, but not necessarily, situated on the inside of the outer casing.

Figure 1:
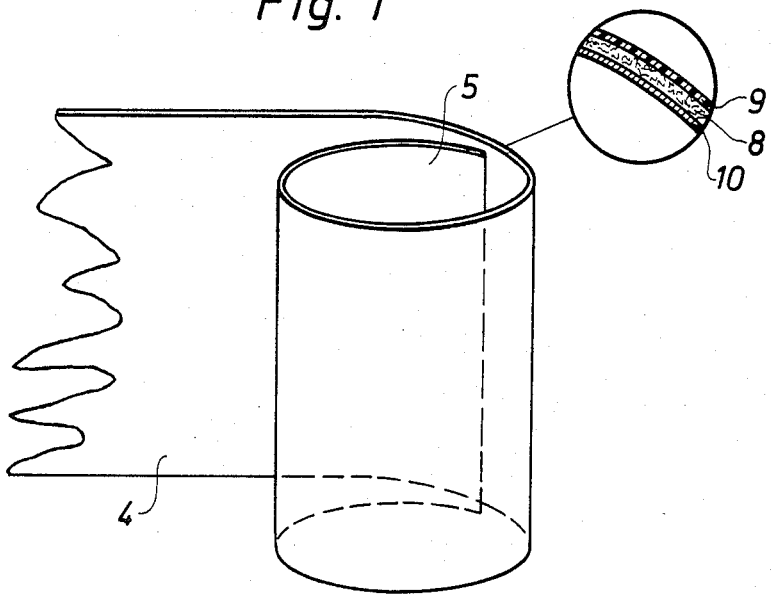
FIG. 1 is a side view of a shell for the packing container in accordance with the invention.
Figure 2:
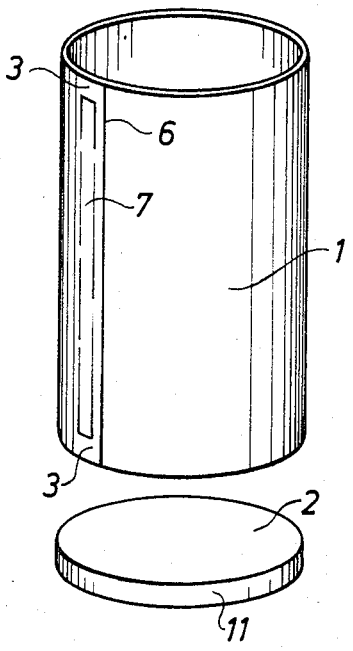
FIG. 2 is a side view of the finished shell and an end plate intended for the same.

The packing container in accordance with the invention has a circular-cylindrical or tubular shell 1 and end plates 2 inserted at the two ends of the shell which are sealed to the edge zones 3 of the shell. In packaging carbonated beverages the pressure in the packing container may be very high and the packing container, therefore, must be given such strength that without any risk of deformation or explosion it can withstand internal pressures of the order of magnitude of 5–6 kg/cm$^2$. The outer casing, consequently, must consist of a rigid material which does not yield to the pressure of the contents. This is achieved in accordance with the invention in different ways in the various parts of the packing container. Insofar as the shell 1 is concerned the required strength and rigidity is obtained in that the shell has a great number of layers of relatively thin material. Preferably the shell is wound from weblike material, e.g. a laminate of paper and thermoplastics. A convolute winding may be used here, a weblike or striplike shell material 4 being wound with the help of a cylindrical mandrel until a tubular shell with the desired number of material layers has been produced. This is illustrated in FIG. 1 where, however, the mandrel has been omitted for the sake of clarity. The leading end 5 of the shell material is sealed after the first turn of the winding to the corresponding part of the nearest outer turn so that an internal, axially extending longitudinal join is produced. Since the shell material preferably includes, besides paper, also a layer of thermoplastic material, e.g. polyethylene, the longitudinal join may be produced by heat sealing with the help of a heatable jaw which has a working surface of a shape corresponding to the shape required for the longitudinal join, and which is pressed from the outside against the first turn of the winding at the level of the leading end of the shell material. After the internal longitudinal join has been provided the mandrel is rotated until the desired number of turns of the shell material 4 have been wound. When the shell comprises the required number of layers, e.g. four layers, the rotation of the mandrel is stopped and the trailing end 6 of the shell is sealed to the material turn located underneath it by an outer longitudinal join 7. This second or outer longitudinal join 7 is formed in the same manner as the inner longitudinal join, that is to say the thermoplastic layer of the shell material is made use of in order to provide by means of heat and pressure an axially extending seal. As can be seen in FIG. 2, the outer longitudinal join 7, like the inner longitudinal join, has a limited extension and in axial direction leaves a narrow region corresponding to the width of the edge region 3 unsealed at both ends of the shell. Apart from the inner and the outer longitudinal join the turns or material layers of the shell are mutually unsealed which is an advantage from a point of view of strength, since the tensile forces which arise in the shell because of the internal pressure are distributed evenly between layers so that the risk of crack formation through uneven loading is reduced. The winding also results in that the unsealed turns will be pressed against each other under stress and "locked", so that no appreciable mutual sliding, with a resulting increase of the diameter of the shell, will occur.

The employment of an inner and an outer longitudinal join which are situated at different places means that in principle each longitudinal join will seal together only two of the turns of the shell. Thus the turns lying in between are mutually unsealed. However, it may also be appropriate to place the inner and the outer longitudinal join right in front of one another so that the two joins can be produced in a single working phase. As mentioned earlier, the shell material includes several layers, preferably a carrier layer of paper material, e.g. kraft paper of the quality 100 g/m$^2$. The kraft paper is covered with a thin layer of thermoplastics, e.g. polyethylene. The paper can also be covered with a layer of aluminium foil, and in the cut away part-figure in FIG. 1 it can be seen how a paper layer 8 is situated centrally between an outer polyethylene layer 9 and an inner layer 10 of aluminium foil. However, the buildup may be varied within wide limits and it is possible, inter alia, to make use of a weblike shell material which is covered only partially by aluminium foil, e.g. over a stretch which corresponds to the inner turn of the winding, which is sufficient to ensure a reliable gas-tightness of the shell. Likewise it is possible to provide only the zones utilized for sealing with a thermoplastic layer used for such sealing, or else the thermoplastic layer may be omitted altogether and the sealing achieved through the application of glue or hotmelt in the zones intended for sealing.

In contrast to the shell 1, the two end plates 2 are manufactured by pressing or deep-drawing, and the material preferably is sheet metal. However, it is also possible to make the end plates of a suitable plastic material which in most cases has to be covered with a layer of gastight material, e.g. aluminium foil or a plastic with good gas barrier characteristics, such as polyvinyl alcohol. The end plates are circular-cylindrical and have a plane or dished central region and a flange or edge region 11 extending around this region. The edge region 11 extends axially and has a diameter which substantially corresponds to the inside diameter of the shell. Furthermore, the edge region 11 has a width which corresponds to, or is slightly smaller than, the width of the edge zone 3 of the shell. In the manufacture of the outer shell for the packing container in accordance with the invention the prefabricated shell 1 and the likewise prefabricated end plate 2 are brought together, whereupon the end plate 2 is inserted into the shell end. It is oriented so that the edge region 11 of the end plate 2 extends in the direction towards the end of the shell. The end plate is inserted to such a depth that the edge zone 3 can be folded over around the edge region 11 of the end plate and sealed to the same by heat sealing.

Before the assembling of the different parts of the outer casing, though, an inner container filled with the contents must be placed inside the shell 1 of the outer casing. The inner container is made of a flexible and expandable plastic material, e.g. a linear polyethylene, preferably LLDPE of quality 30 g/m$^2$. The latter material is very elastic and expandable as well as being heat sealable which makes it very suitable for the manufacture of the inner container.

In the forming of the inner container a blown tube material is used or else a weblike material which is converted to tubular shape by its two longitudinal edges being sealed together to a liquid-tight seal 12, which extends axially along the tube 13. After filling of the tube with the required contents it is pressed together by means of a pair of co-operating sealing jaws (not shown) so that a transverse sealing region 14 is produced wherein the material layers of the tube 13 have been pressed against each other with simultaneous forcing out of the contents. They have been heat sealed so as to form a liquid-tight seal. As a result a tight, cushion-shaped container 15 is produced underneath the sealing region 14 which, however, is still mechanically joined to the material tube 13. The inner container 15 is separated from the material tube 13 by a transverse cut placed substantially centrally in the sealing region 14. As a result the cushion-shaped inner container beside the axial seals 12 has two transverse sealing fins 16 intersecting them. As the sealing together of the filled material tube 13 takes place below the liquid level, the sealed-off, finished, inner container 15 will be completely filled with contents. However, carbon dioxide gradually will be given off by the contents which means that after a time the inner container will have a free space (so-called headspace) which contains gas originating from the contents. The volume of the inner container also increases during this process and it is necessary, therefore, to place the inner container relatively quickly after its formation into the pressure-resistant outer casing.

Figure 3:
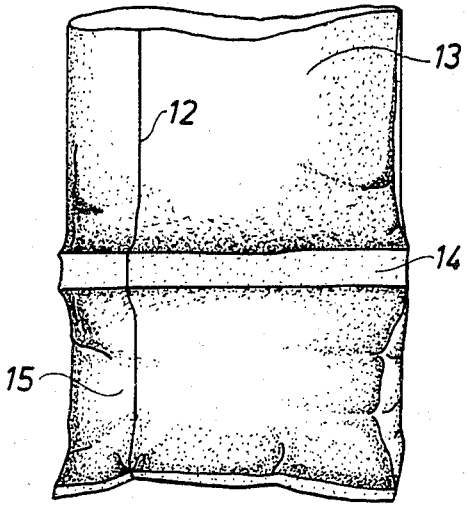
FIG. 3 is a side view of an inner container for packing containers in accordance with the invention.
Figure 4:
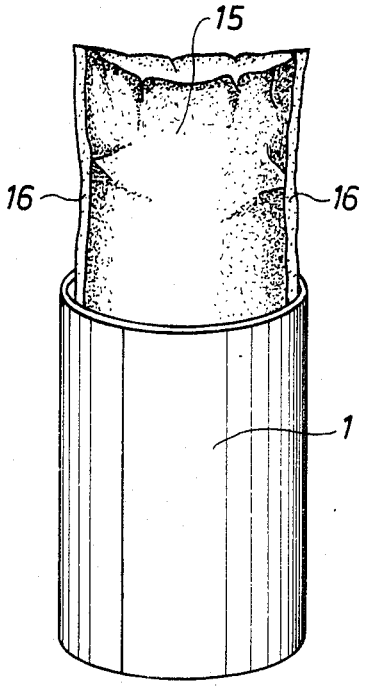
FIG. 4 is a side view of the finished inner container as it is introduced into the shell.

As can be seen from FIGS. 3 and 4, the inner container 15, after it has been separated from the material tube 13, is placed inside the outer casing or shell 1. It is oriented so that the two sealing fins 16 of the inner container extend in axial direction of the shell. In this position the inner container 15 can be introduced into the shell 1 without any difficulty since any formation of gas seriously affecting the shape and size of the inner container has not yet had time to start within the contents.

Figure 5:
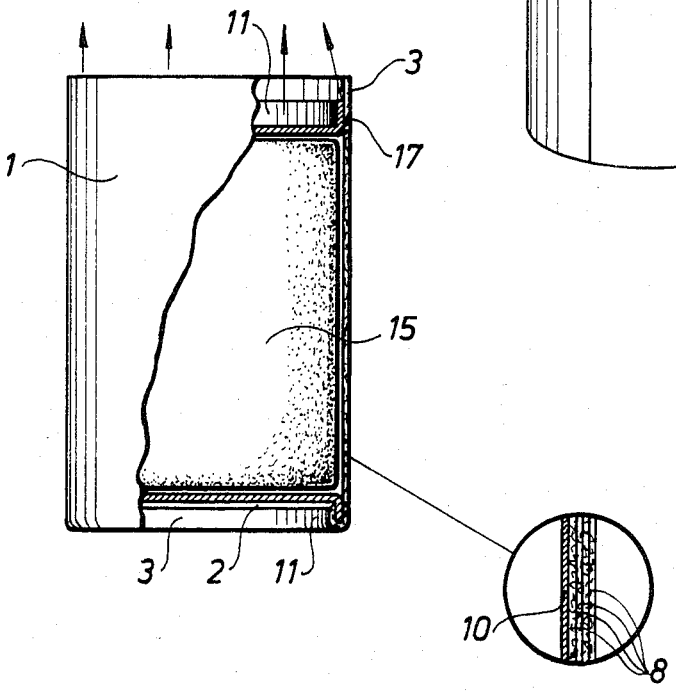
FIG. 5 is a partial cross-section of the packing container in accordance with the invention partly in cross-section, the upper end of the packing container having not yet been given its full shape.

After the inner container 15 filled with contents has been introduced into the outer container or more particularly into the shell 1 the two end plates 2 are placed in the required positions at the end of the shell. More particularly, the end plates 2 are inserted into the shell ends to such a depth that they rest against the inner container 15 situated inside the shell. The length of the shell 1 is adapted so that the shell extends only with the edge zones 3 beyond the end plates 2 so placed, as can be seen at the upper end of the packing container in accordance with the invention as shown in partly cut away form in FIG. 5.

As mentioned earlier, it is the prime function of the inner container 15 to act as a liquid-tight layer preventing the contents from running out of the packing container. The strength and the rigidity as well as the gas-tightness of the packing container are provided by the outer casing, and in the cut out of FIG. 5 a section through the shell wall shows how the same can be built up of a number of layers 8 of paper (and possibly plastics) and an internal gastight layer 10 of aluminium foil. The various, mutually unsealed layers 8 of paper jointly impart adequate strength and stability to the shell 1, and the internal aluminium foil layer 10 effectively prevents gas from passing through the shell wall.

In packaging certain sensitive products, e.g. beer, whose flavour and quality are affected by the oxygen in the air, it is essential, moreover, that no air should be entrapped with the contents in the packing container. As mentioned already, the inner container 15 in accordance with the invention is completely filled with contents and the absence of air in the inner container is guaranteed automatically by virtue of the method of manufacture comprising sealing of the filled tube below the liquid level. However, since the gastight layer 10 of the packing container is connected to the shell, any air present in the outer casing will be able to affect the contents of the inner container after the manufacture of the packing container. It is essential therefore that there should not be any harmful air space between the inner container and the outer casing.

The inner container must not be made too large though in relation to the shell, since in such a case it would be practically impossible to introduce the container filled with contents into the shell. These problems are solved, however, by a suitable choice of material for the inner container 15 so that the same after it has been inserted into the shell 1 can expand and fill out the available space. For this purpose preferably the following method may be used.

After the wholly filled inner container 12 has been introduced into the shell 1 the two end plates 2 are inserted to such a depth into the two ends of the shell 1 that the edge zones 3 of the shell extend beyond the edge regions 11 of the end plates. The length of the shell 1 is chosen so in relation to the length of the container 15 that the surfaces of the end plates facing one another are pressed against the corresponding end surfaces of the container 15. The outer casing now completely encloses the inner container, but not in a gastight manner, since annular gaps 17 exist between the edge region 11 of the two end plates 2 and the inner surface of the shell 1 through which gas can escape in a fairly unhindered manner. The shell 1 and the end plates 2 are retained in this position with the help of external elements (not shown) which rest against the outward facing surfaces of the end plates. In this position the pressure in the inner container is increased by causing the contents to give off gas to such an extent that the inner container commences to expand. The development of gas is brought about in that the carbon dioxide bound in the contents is caused to dissolve out. This can be done by vibrating the packing container, e.g. with the help of a vibrator. A strong pressure is so produced causing the pouch to expand so that it rests fully against the shell and the inside of the end plates while the residual air present in the outer casing is forced out through the gaps 17 between the end plates and the shell. After completed expansion, the two edge zones 3 of the shell 1 are folded about 180° over the edge regions 11 of the end plates and sealed to the same. Since the end plates 2 are made of sheet metal or layers of gastight material the outer casing of the packing container will now be sealed in a completely gas-tight manner so that any gas exchange is prevented.

The gastight layer of the shell, as mentioned previously, may be constituted of an aluminium foil laminated to the shell material or any other type of gastight material. Since the gastight layer by virtue of its position inside the outer casing is not subjected to stretchings or other stresses either during the manufacture of the packing container or later, it is even possible to select a non-expandable material. This had been a problem in earlier designs which prevented the use of e.g. aluminium foil. As it is sufficient for the aluminium foil to extend over one turn around the shell it may be advantageous for economic reasons to provide only the inside of the shell with aluminium foil. This can be achieved either in that only the leading end of the shell material is provided with aluminium foil or else in that a number of different types of shell material are used, that is to say a shell material covered with aluminium foil for the innermost turn and a non-covered shell material for the remaining turns. In addition the outer turn of the shell may be manufactured from a third type of material which is provided with decoration and any kind of surface coating suitable for the outside, e.g. polyethylene. The end plates are preferably made of sheet metal and are given in this manner automatically adequate gas-tightness, but it is also possible to manufacture the end plates from some other material, e.g. plastics. In that case the end plates are provided, like the shell, with a layer of e.g. aluminium foil.

The material layers 8 making up the shell 1 are mutually unsealed, as mentioned previously, with the exception of the longitudinal sealing zones and the two sealing zones between the shell and the end plates 2 extending along the edge zones 3 of the shell. By this design it is ensured that forces and stresses, especially the tensile stresses caused by the pressure of the contents, are distributed evenly in the different material layers, thus appreciably reducing the risk of crack formation or other damages. The mutually unsealed material layers, moreover, have the effect that the folding of the edge zones 3 of the shell over the edge regions of the end plates can be carried out without subjecting the outer material layer to stresses, since the material layers can slide in relation to one another when they are being folded. By the subsequent sealing which may take place by high frequency or ultrasonic sealing, not only the edge zones of the shell are sealed to the edge regions of the end plates, but also the different thermoplastic-coated material layers of the shell are sealed to one another, which makes the folding over "permanent" and ensures a very strong and reliable seal between end plates and shell.

The preferred embodiment of the packing container in accordance with the invention also has an opening arrangement which is placed or formed in the upper end plate. The opening arrangement may be of a conventional type and has a threaded bottle-neck with a screw-cap or a partially punched-out tear-up part of the end plate provided with a pull-lug. Irrespectively of the design of the opening arrangement the part which is adapted to be removed must be sealed to the corresponding region of the inner container, since it is desirable that the inner container should be opened at the same time as the outer container so that the contents should be accessible for consumption.

The packing container and the method of manufacture of the same in accordance with the invention make it possible by making use of several materials, each one of optimum suitability, to form an appropriate packing container for pressurized contents at the lowest possible costs. Owing to the construction of the shell from a number of layers not attached to one another, the packing container is given, among other things, high strength and good capacity to withstand the internal pressure originating from the contents. Due to the unique method of manufacture which makes it possible to exclude contact between the contents and air, the contents are given optimum conditions for a long keeping quality even in demanding surroundings.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A method for the manufacture of a packing container for pressurized contents having an outer casing and a liquid-tight inner container, the method comprising the steps of introducing the inner container and its contents into the outer casing, through open ends provided in said outer casing, the outer casing circumferentially enclosing the inner container in a non-gastight manner, placing end plates at the open ends of the outer casing, vibrating the packing container so as to promote the contents to give off gas and expand the inner container to force out any air present in the outer casing, and sealing the end plates in a gas-tight manner to the outer casing after release of the gas and after the inner container has expanded.

2. The method in accordance with claim 1, wherein the outer casing is made by winding a weblike material, the ends of which are sealed to adjoining turns of the winding.

3. The method in accordance with claim 2, wherein the leading end of the outer casing material during the winding of the shell is sealed to the material turn located on the outside by an inner longitudinal joint, whereupon the required number of turns are wound and the trailing end of the shell material is sealed to the material turn located underneath it by an outer longitudinal joint.

4. The method in accordance with claim 3, wherein the inner and the outer longitudinal joints are located opposite one another.

5. The method in accordance with claim 4, wherein the inner and the outer longitudinal joint seal the material layers situated therebetween.

6. The method in accordance with claim 1, wherein the end plates are inserted into the desired position in the two ends of the outer casing and are retained in this position during the expansion of the inner container, whereupon the end plates are sealed to edge zones of the shell.

7. The method in accordance with claim 6, wherein the edge zones of the outer casing are folded around the edge region of the end plates prior to sealing.

8. The method in accordance with claim 1, wherein the inner container is made of a stretchable, liquid-tight plastic material which is converted to tubular form, is filled with the required contents and is sealed transversely so as to form a substantially cushion-shaped inner container.

* * * * *